US007579790B2

(12) United States Patent
Tipton

(10) Patent No.: US 7,579,790 B2
(45) Date of Patent: Aug. 25, 2009

(54) MULTIPLE GAS DISCHARGE LAMP INTERLEAVE TRIGGER CIRCUIT

(75) Inventor: Frederick James Tipton, Acton, MA (US)

(73) Assignee: Xenon Corporation, Wilmington, MA (US)

( * ) Notice: Subject to any disclaimer, the term of this patent is extended or adjusted under 35 U.S.C. 154(b) by 14 days.

(21) Appl. No.: 11/614,272

(22) Filed: Dec. 21, 2006

(65) Prior Publication Data

US 2008/0150443 A1 Jun. 26, 2008

(51) Int. Cl.
*H05B 37/00* (2006.01)

(52) U.S. Cl. ..... 315/323; 315/224; 315/209 R; 315/312; 315/56

(58) Field of Classification Search ..... 315/312–326, 315/224, 225, 209 R, 219, 56–59
See application file for complete search history.

(56) References Cited

U.S. PATENT DOCUMENTS 4,167,669 A * 9/1979 Panico ..... 250/432 R
4,348,615 A * 9/1982 Garrison et al. ..... 315/219
6,118,639 A * 9/2000 Goldstein ..... 361/55
6,362,575 B1 * 3/2002 Chang et al. ..... 315/224
7,091,495 B2 8/2006 Panico et al.
7,150,806 B2 12/2006 Panico et al.
2002/0166043 A1 11/2002 Panico
2002/0186014 A1 * 12/2002 Panico et al. ..... 324/360
2003/0044311 A1 3/2003 Sousa et al.
2003/0128554 A1 * 7/2003 Crewson et al. ..... 363/16
2004/0028553 A1 2/2004 Panico
2005/0023988 A1 * 2/2005 Komatsu et al. ..... 315/224
2005/0252866 A1 11/2005 Beckinghausen
2007/0095480 A1 5/2007 Panico et al.
2007/0247080 A1 10/2007 Tipton
2008/0001321 A1 1/2008 Panico et al.

* cited by examiner

*Primary Examiner*—Tuyet Vo
(74) *Attorney, Agent, or Firm*—Wilmer Cutler Pickering Hale and Dorr LLP

(57) ABSTRACT

Embodiments are disclosed for apparatus and methods for increasing the reliability of the flash discharge response in pulsed gas discharge lamps. One embodiment includes a system comprising two gas discharge lamps having cathodes and anodes connected in parallel to a common power source. The lamps are alternatingly triggered such that the discharge from a first lamp reduces residual partial ionization of the gas in a second lamp and vice-versa.

37 Claims, 5 Drawing Sheets

MULTIPLE GAS DISCHARGE LAMP INTERLEAVE TRIGGER CIRCUIT

BACKGROUND OF THE INVENTION

The present invention generally relates to ignition of pulsed gas discharge lamps, such as a xenon flash lamp.

Gas discharge lamps contain a rare gas, such as xenon or krypton, in a transparent bulb. The gas may be at pressures above or below atmospheric pressure. The lamps have a cathode and an anode through which an electrical current is provided to create an electrical arc. In order for the gas to conduct the electrical energy between the electrodes, the gas is ionized to reduce its electrical resistance. Once the gas is ionized, electrical energy conducts through the gas and excites the molecules of the gas. When the molecules return to their unexcited energy state, they release light energy.

Pulsed gas discharge lamps are operated such that a train of light pulses is emitted from the lamp rather than a continuous light emission. In this type of lamp, the electrical current provided across the cathode and anode is released in short bursts, rather than supplied in a continuous manner. This results in a single discharge or "flash" of light.

Typically, in order to ionize the gas, a high voltage pulse is applied to an ignition electrode on the outside of the bulb, such as a wire mesh wrapped around the outside of the bulb. When a voltage is applied to the wire mesh, the gas inside the bulb is ionized, and the gas may then conduct electricity through the main electrodes. This ionization may also be achieved by an injection triggering method, which applies a voltage directly into a lamp through one or more of the lamp electrodes.

UV light emitted by gas discharge lamps may be used for many applications, including UV curing or sanitization, decontamination, and sterilization. For example, a gas discharge lamp may be placed in close proximity to a conveyor, which moves items to be cured past the lamp. As an item to be cured passes the lamp, the lamp is discharged in order to expose the item to UV radiation. High conveyor line speeds are often required in order to achieve high production rates. This in turn requires the pulsed gas discharge lamp to be operated at a high pulse rate.

SUMMARY

Each time a pulsed gas discharge lamp is discharged, a delay time is required for the ionization within the lamp to dissipate before the lamp can be discharged again. The higher the energy per pulsed discharge, the longer the ionization in the lamp takes to dissipate. As described in greater detail below, attempting to trigger the lamp at too great a pulse rate at a given energy level can cause problems with reliable lamp operation. These problems include lamp self-triggering, hold-over, and/or the lamp entering a simmering mode, in which a sustained arc of low level current flows through the lamp rather than the occurrence of a single flash discharge.

In one aspect, the invention includes a pulsed lamp system including a first pulsed gas discharge lamp for connection to a power source, a second pulsed gas discharge lamp for connection to the power source in parallel to the first pulsed gas discharge lamp, and a control system. The control system alternatingly triggers the first and second gas discharge lamps at an individual pulse rate of at least about 10 Hz and an individual energy level in joules such that the product of the pulse rate and energy level is at least about 1000.

In another aspect, the invention includes a pulsed lamp system including a first pulsed gas discharge lamp for connection to a power source, a second pulsed gas discharge lamp for connection to the power source in parallel to the first pulsed gas discharge lamp, and a control system. The control system alternatingly triggers the first and second gas discharge lamps at an individual energy level of at least about 10 joules and an individual pulse rate in Hz such that the product of the pulse rate and energy level is at least about 1000.

In a further aspect of the invention, a pulsed lamp system includes a first pulsed gas discharge lamp for connection to a power source, a second pulsed gas discharge lamp for connection to the power source in parallel to the first pulsed gas discharge lamp, and a control system. The control system alternatingly triggers the first and second gas discharge lamps at an individual energy level in joules and an individual pulse rate in Hz such that the product of the pulse rate and energy level is at least about 1000.

Embodiments are disclosed for apparatus and methods for increasing the reliability of the flash discharge response in pulsed gas discharge lamps. One embodiment includes a system comprising two gas discharge lamps having cathodes and anodes connected in parallel to a common power source. The lamps are alternatingly triggered such that each lamp may be reliably discharged at an individual pulse rate and individual energy level that is higher than what could be reliably achieved without the alternating trigger sequence.

Another embodiment includes a system having more than two gas discharge lamps. The lamps' cathodes and anodes are connected in parallel to a common power source. The lamps are alternatingly triggered such that each lamp may be reliably discharged at an individual pulse rate and individual energy level that is higher than what could be reliably achieved without the alternating trigger sequence.

BRIEF DESCRIPTION OF THE DRAWINGS

For a more complete understanding of various embodiments of the present invention, reference is now made to the following descriptions taken in connection with the accompanying drawings in which.

DETAILED DESCRIPTION OF THE EMBODIMENTS

Figure 1:
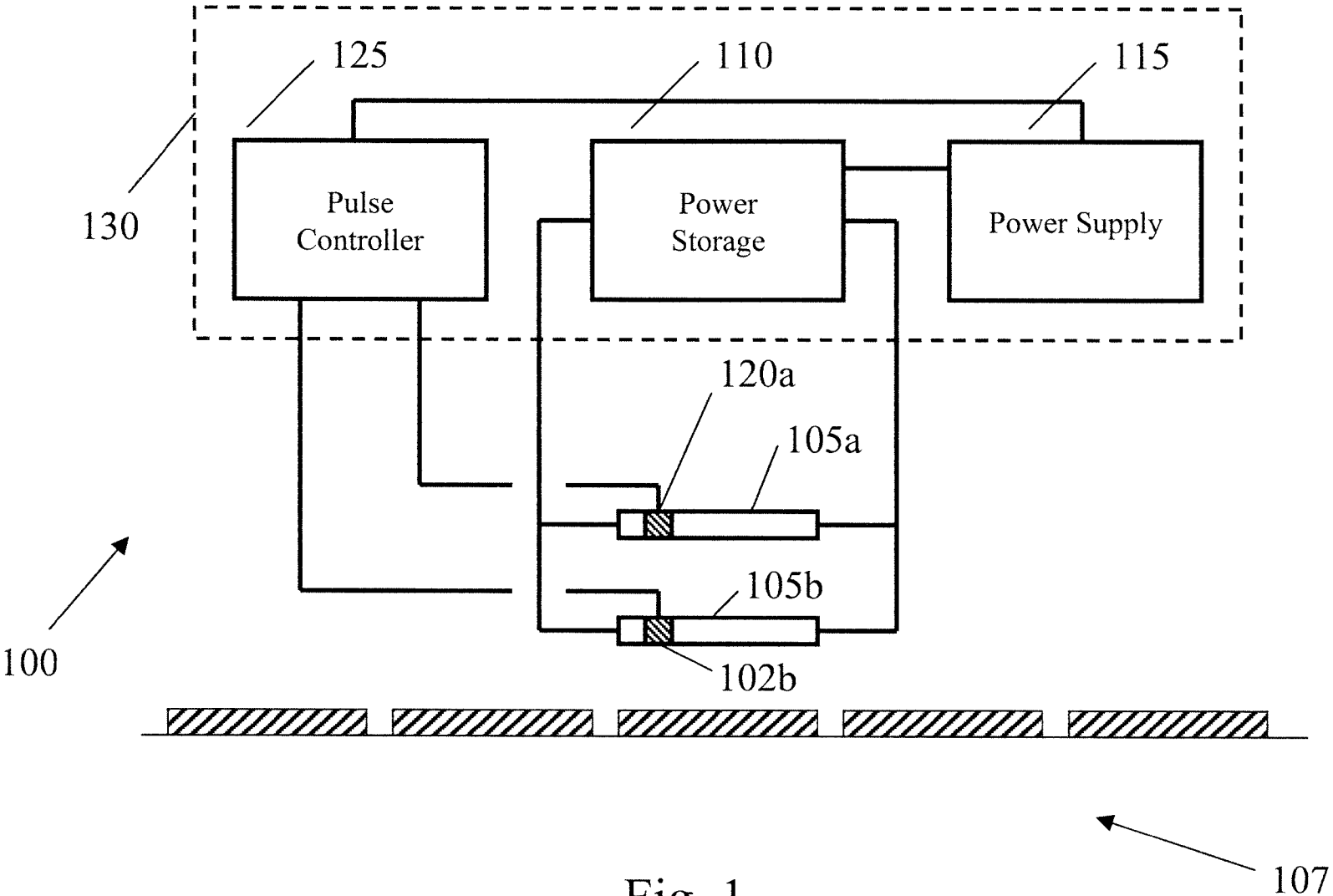
FIG. 1 is an illustration of an apparatus according to an embodiment of the invention.

FIG. 1 is an illustration of a pulsed gas discharge lamp system 100. The system 100 includes two gas discharge lamps 105*a* and 105*b* in close proximity to a conveyor 107. Conveyor 107 contains articles to be exposed to light from the lamps. In at least one embodiment, lamps 105*a* and 105*b* are substantially similar and are xenon flash lamps. Lamps 105*a* and 105*b* are connected in parallel to a power storage device 110. Power storage device 110 stores electrical energy generated by a power supply 115 and includes one or more capacitors to store the electrical energy. Power storage device 110 provides the necessary electrical energy to lamps 105*a* and 105*b* to enable the lamps to create a flash discharge when triggered by an ignition pulse.

Lamps 105*a* and 105*b* each include separate ignition electrodes 120*a* and 120*b*, which can be formed by a wire encircling a portion of lamp tube. In at least one embodiment, ignition electrodes 120*a* and 120*b* are substantially similar. The wire forming ignition electrode 120*a* is wrapped around the outside of a portion of lamp tube as it passes from one end of lamp tube to the other. In other embodiments, the cathode or anode of the lamp may serve as the ignition electrode. In yet further embodiments, the ignition electrode may be located inside the lamp.

Ignition electrodes 120*a* and 120*b* are separately connected to a pulse controller 125. In order to create a discharge from lamp 105*a*, an electrical potential is applied between the cathode and anode of lamp 105*a* by power storage device 110. This electrical potential must be high enough to create an electrical arc through the gas in lamp 105*a* once the gas is ionized. Pulse controller 125 creates a voltage signal in the form of a single pulse in the range of 20 kV-30 kV, which is applied to ignition electrode 120*a* to ionize the gas. Upon ionization, the conductivity of the gas increases, allowing an arc to form between the cathode and anode of lamp 105*a*, thereby creating a flash of light. Lamp 105*b* operates in substantially the same manner.

Power storage device 110, power supply 115, and pulse controller 125 can be present in a lamp control circuit 130. In alternate embodiments, the individual power and control components can be separate devices.

As mentioned above, lamp operating problems occur within a particular operating region. This region is a function of operating voltage, lamp pressure, pulse energy, lamp temperature, and the amount of time the lamp has remained unused since manufacture. In general, however, lamp temperature and pulse energy are believed to have the most significant impact on operating reliability, and the problematic region can be expressed in terms of operating temperature and pulse energy. As a lamp begins to warm, the energy level at which the lamp exhibits operating problems increases. Thus, a given lamp may be operated at a relatively high energy level if the lamp temperature is maintained above a corresponding minimum temperature.

However, operating a lamp at too high a temperature can result in a lamp hold-over condition, mentioned above. This condition can destroy or significantly reduce the operating life of the lamp. In addition, the frequency of lamp pulses greatly affects the operating temperature of the lamp. Thus, a lamp may not reach the desired minimum temperature because a lamp may be subject to a maximum frequency limitation imposed by the particular lamp application. In these instances, the lamp pulses must be maintained below a given energy level to avoid operating problems.

For example, normal pressure xenon lamps can be run at or below an energy level of 10 joules per pulse at 100 pulses per second (Hz) to avoid operating problems. However, low pressure lamps exhibit an increase in operating problems at these conditions. Likewise, a normal pressure xenon lamp can be reliably operated at or below an energy level of 207 joules per pulse at 10 pulses per second. Again, low pressure lamps have difficulty operating reliably in this region.

Figure 2:
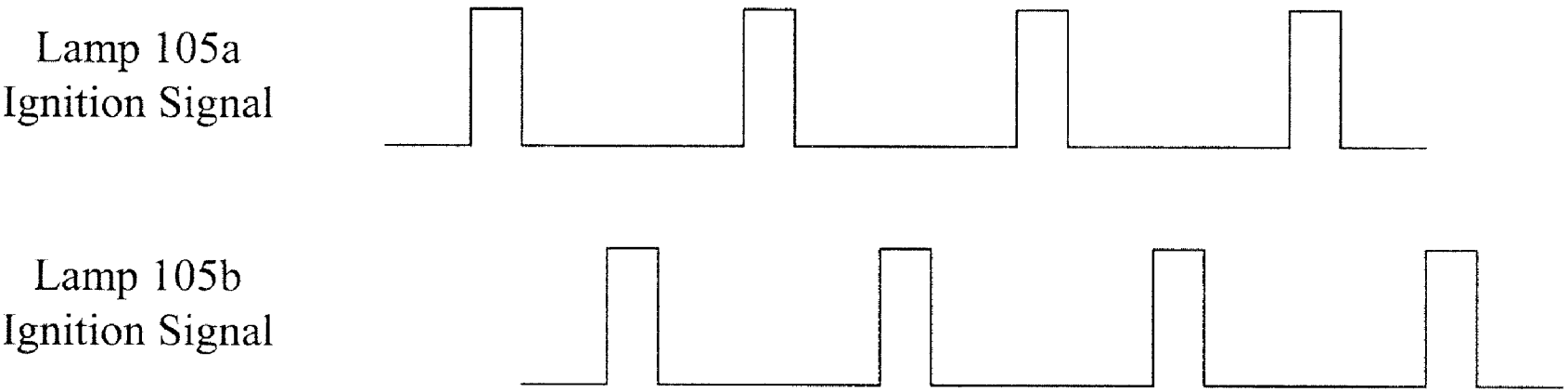
FIG. 2 is an illustration of two interleaved pulse discharge signals for two pulsed gas discharge lamps.

The problems of lamp self-triggering, hold-over, and/or the lamp entering a simmering mode are believed to be caused by residual partial ionization of the gas inside the lamp after the lamp discharges. FIG. 2 illustrates an interleaved pattern of ignition signals of lamps 105*a* and 105*b* of FIG. 1 according to an embodiment of the invention. Lamps 105*a* and 105*b* are not merely being discharged in an alternating fashion, but each lamp is being triggered while residual partial ionization is believed to be present in the other lamp. Thus, the alternating trigger pulses are timed to occur within a predetermined time after the other lamp has discharged.

It is believed that by adding second lamp 105*b* in parallel to first lamp 105*a*, residual partial ionization remaining in lamp 105*a* is reduced by the discharge of lamp 105*b* and vice-versa. The sudden drop in voltage across the cathode and anode of lamp 105*b* that occurs when the lamp discharges is thought to induce some of the remaining ionized gas in lamp 105*a* to return to its ground state. Thus, embodiments of the invention are particularly useful when operating at relatively high lamp energy loading levels and relatively high pulse rates, when residual ionization in the lamps is thought to be most problematic. Alternating the discharge of lamps 105*a* and 105*b* in this manner allows each lamp to be operated reliably at a higher pulse rate than if one of the lamps were operated alone.

Figures 3, 4:
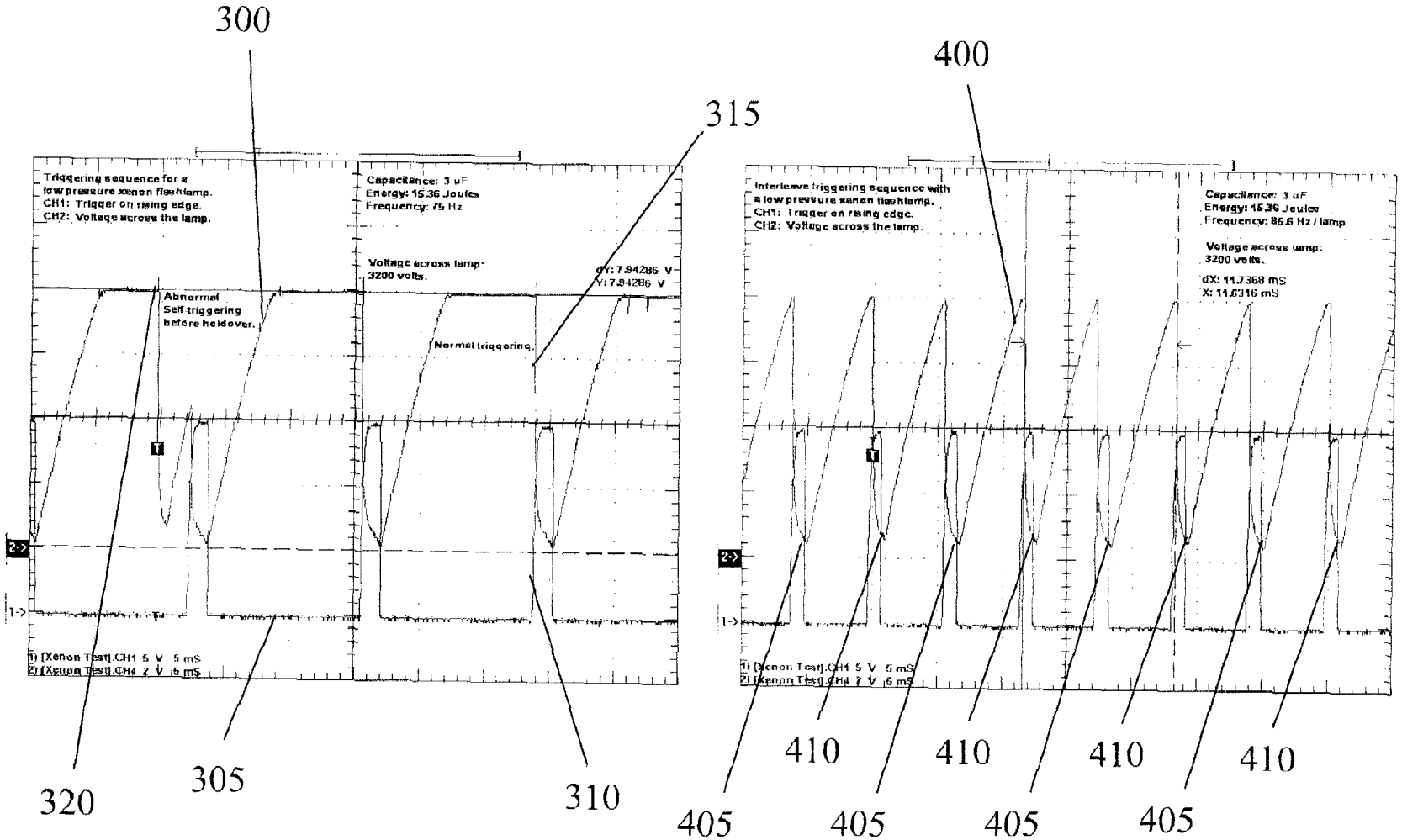
FIG. 3 is an illustration of a single lamp triggering sequence.
FIG. 4 is an illustration of an interleaved dual lamp triggering sequence.

FIG. 3 illustrates a discharge sequence for a 20-inch long, 7 mm bore xenon flash lamp. A lamp voltage signal 300 measures the voltage across the lamp. A trigger voltage signal 305 measures the voltage applied to an ignition electrode of the lamp. During normal operation, the lamp discharges on a rising edge 310 of trigger voltage signal 305. Lamp voltage signal 300 decreases upon discharging (shown at 315).

However, the lamp behaves erratically when operated at a pulse rate of 75 pulses per second with an energy loading of 15.36 joules per pulse at 3,200 volts. One example of this erratic behavior is a self-triggering event 320 in which the lamp discharge occurs before trigger voltage signal 305 is initiated. As illustrated by FIG. 4, however, the lamp can be reliably operated at the same energy loading with a higher pulse rate of 85.6 pulses per second by adding a second similar lamp in parallel to the first lamp and alternating the triggering of the two lamps, as described above. A lamp voltage signal 400 measures the voltage across both lamps because the lamps are connected in parallel. Thus, minima 405 of lamp voltage signal 400 are attributable to the first lamp, while minima 410 are attributable to the second lamp. Therefore, the combined pulse rate for the two lamps is about 171 pulses per second. In fact, individual lamp pulse rates as high as 112.45 pulses per second and higher can be achieved at this energy level.

Figure 6:
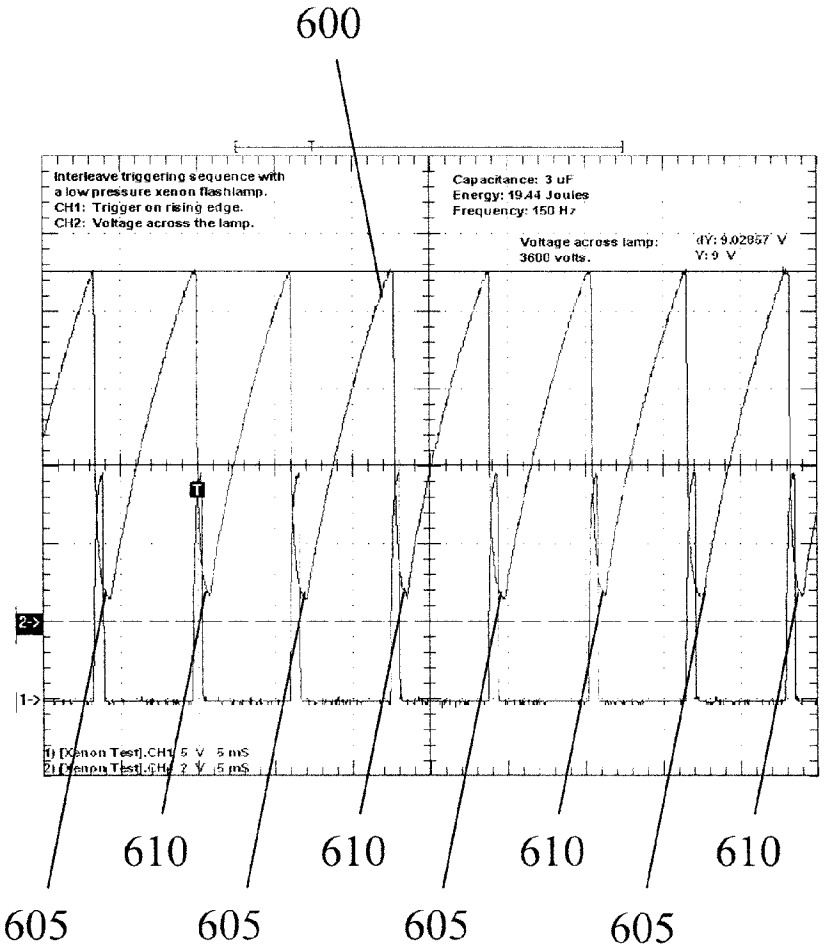
FIG. 6 is an illustration of an interleaved dual lamp triggering.
Figure 5:
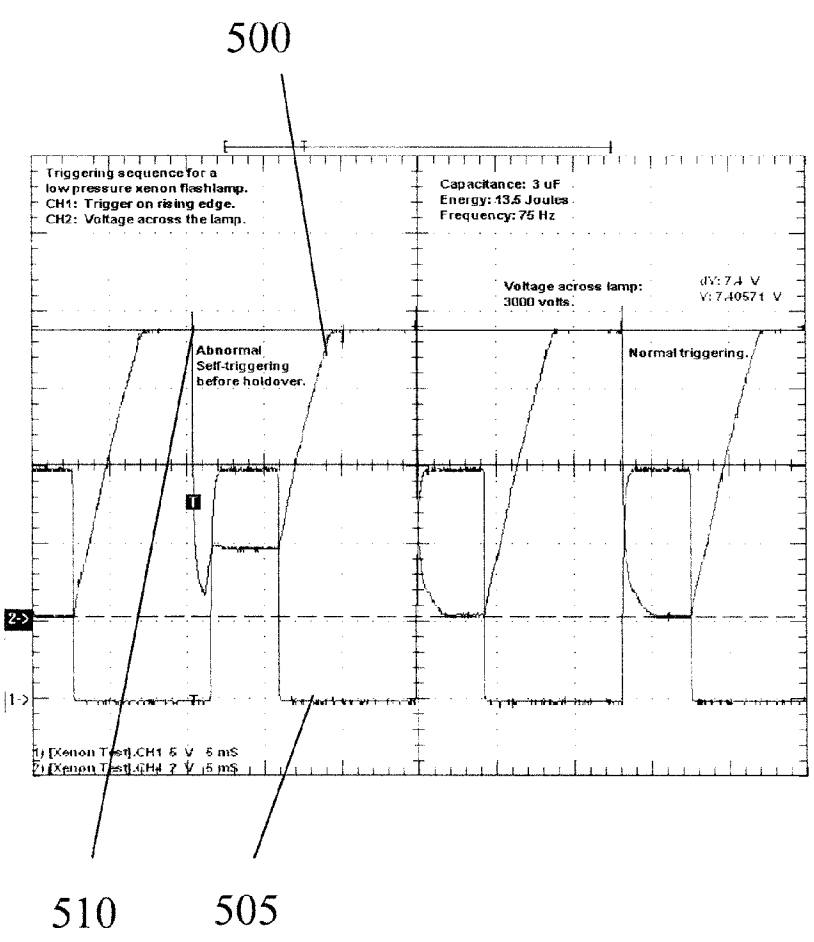
FIG. 5 is an illustration of a single lamp triggering sequence.

Embodiments of the invention also provide for increasing the lamp energy loading per pulse without having to reduce the pulse rate. As explained above, the higher the energy per pulsed discharge, the longer the ionization in the lamp takes to dissipate. FIG. 5 illustrates a discharge sequence for the 20-inch long, 7 mm bore lamp described above. As before, a lamp voltage signal 500 measures the voltage across the lamp. A trigger voltage signal 505 measures the voltage applied to an ignition electrode of the lamp. This lamp behaves erratically when operated at a pulse rate of 75 pulses per second with an energy loading of 13.5 Joules per pulse at 3,000 volts. Also as before, a self-triggering event 510 is illustrated. FIG. 6 illustrates, however, that the lamp can be reliably operated at this pulse rate (75 pulses per second per lamp, 150 pulses per second combined) with an energy loading of 19.44 Joules per pulse by adding a second similar lamp in parallel to the first lamp and alternating the triggering of the two lamps. As explained above, a lamp voltage signal 600 measures the voltage across both lamps because the lamps are connected in parallel. Thus, minima 605 of lamp voltage signal 600 are attributable to the first lamp, while minima 610 are attributable to the second lamp.

Figure 8:
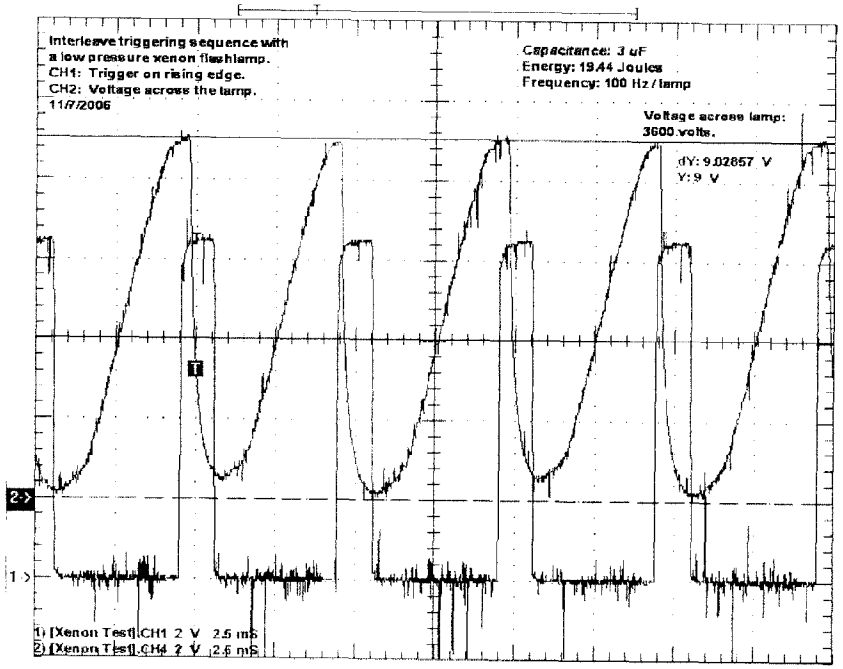
FIG. 8 is an illustration of an interleaved dual lamp triggering sequence.
Figure 7:
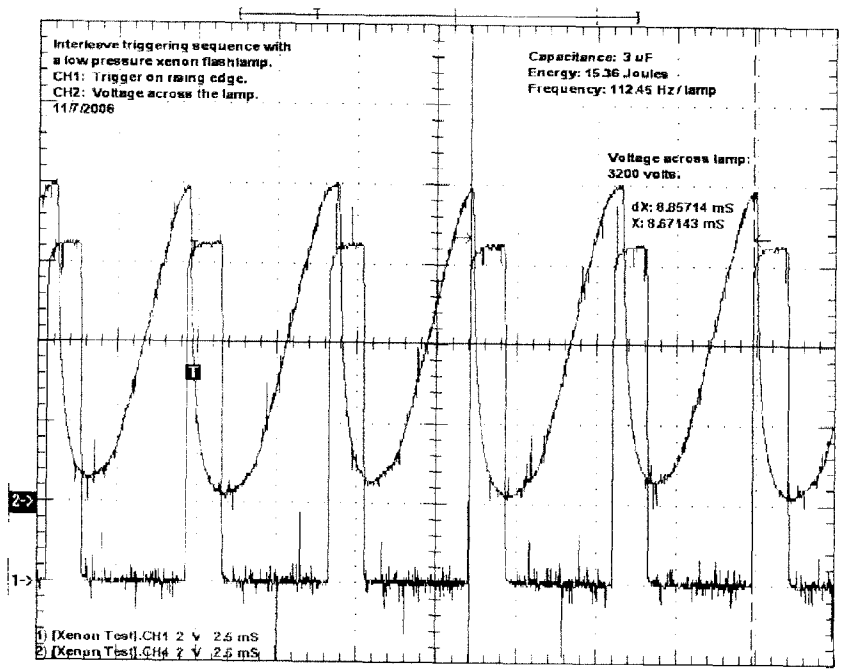
FIG. 7 is an illustration of an interleaved dual lamp triggering sequence.

FIG. 7 and FIG. 8 illustrate additional examples of possible operating regions using embodiments of the present invention. FIG. 7 shows reliable dual lamp interleaved operation at an energy level of 15.36 joules per pulse and 112.45 pulses per second per lamp at 3,200 volts. FIG. 8 shows reliable dual lamp interleaved operation at an energy level of 19.44 joules per pulse and 100 pulses per second per lamp at 3,600 volts.

Embodiments of the invention include having more than two lamps connected to power storage, so long as the lamps are triggered in an alternating fashion. In addition, embodiments of the invention work with lamps operating in a wide variety of systems, including those with a lamp configuration (shape) that is linear, helical, or spiral in design; a cooling system that is ambient, forced air, or water; a wavelength that is broadband or optical filter selective; and a lamp housing window that is made of quartz, SUPRASIL brand quartz, or sapphire for spectral transmission.

As will be realized, the embodiments and its several details can be modified in various respects, all without departing from the invention. For example, embodiments have been described for use with xenon flash lamps. Other embodiments of the invention are suitable for use with other gas discharge lamps, such as metal halide, mercury, sodium, and other noble-halide based lamps. The lamps may be placed on the same side of an article on a conveyor, or the lamps may be placed on opposite sides of the article. Accordingly, the drawings and description are to be regarded as illustrative in nature and not in a restrictive or limiting sense.

What is claim is:

1. A pulsed lamp system comprising:

a first pulsed gas discharge lamp for connection to a power source;

a second pulsed gas discharge lamp for connection to the power source in parallel to the first pulsed gas discharge lamp;

a control system for alternatingly triggering the first and second gas discharge lamps at an individual pulse rate of at least about 10 Hz and an individual energy level in joules such that the product of the pulse rate and energy level is at least about 1000.

2. The pulsed lamp system of claim 1, wherein the first and second gas discharge lamps are discharged at an individual pulse rate of at least about 75 Hz.

3. The pulsed lamp system of claim 1, wherein the first and second gas discharge lamps are discharged at an individual pulse rate of at least about 85.6 Hz.

4. The pulsed lamp system of claim 1, wherein the first and second gas discharge lamps are discharged at an individual pulse rate of at least about 100 Hz.

5. The pulsed lamp system of claim 1, wherein the first and second gas discharge lamps are discharged at an individual pulse rate of at least about 112.45 Hz.

6. The pulsed lamp system of claim 1, wherein the first and second gas discharge lamps are discharged at an individual energy level of at least about 13.5 joules.

7. The pulsed lamp system of claim 1, wherein the first and second gas discharge lamps are discharged at an individual energy level of at least about 15.36 joules.

8. The pulsed lamp system of claim 1, wherein the first and second gas discharge lamps are discharged at an individual energy level of at least about 19.44 joules.

9. A pulsed lamp system comprising:

a first pulsed gas discharge lamp for connection to a power source;

a second pulsed gas discharge lamp for connection to the power source in parallel to the first pulsed gas discharge lamp;

a control system for alternatingly triggering the first and second gas discharge lamps at an individual energy level of at least about 10 joules and an individual pulse rate in Hz such that the product of the pulse rate and energy level is at least about 1000.

10. The pulsed lamp system of claim 9, wherein the first and second gas discharge lamps are discharged at an individual energy level of at least about 13.5 joules.

11. The pulsed lamp system of claim 9, wherein the first and second gas discharge lamps are discharged at an individual energy level of at least about 15.36 joules.

12. The pulsed lamp system of claim 9, wherein the first and second gas discharge lamps are discharged at an individual energy level of at least about 19.44 joules.

13. The pulsed lamp system of claim 9, wherein the first and second gas discharge lamps are discharged at an individual pulse rate of at least about 75 Hz.

14. The pulsed lamp system of claim 13, wherein the first and second gas discharge lamps are discharged at an individual energy level of at least about 19.44 joules.

15. The pulsed lamp system of claim 9, wherein the first and second gas discharge lamps are discharged at an individual pulse rate of at least about 85.6 Hz.

16. The pulsed lamp system of claim 15, wherein the first and second gas discharge lamps are discharged at an individual energy level of at least about 15.36 joules.

17. The pulsed lamp system of claim 9, wherein the first and second gas discharge lamps are discharged at an individual pulse rate of at least about 100 Hz.

18. The pulsed lamp system of claim 17, wherein the first and second gas discharge lamps are discharged at an individual energy level of at least about 19.44 joules.

19. The pulsed lamp system of claim 9, wherein the first and second gas discharge lamps are discharged at an individual pulse rate of at least about 112.45 Hz.

20. The pulsed lamp system of claim 19, wherein the first and second gas discharge lamps are discharged at an individual energy level of at least about 15.36 joules.

21. A pulsed lamp system comprising:

a first pulsed gas discharge lamp for connection to a power source;

a second pulsed gas discharge lamp for connection to the power source in parallel to the first pulsed gas discharge lamp;

a control system for alternatingly triggering the first and second gas discharge lamps at an individual energy level in joules and an individual pulse rate in Hz such that the product of the pulse rate and energy level is at least about 1000.

22. The pulsed lamp system of claim 21, wherein the product of the individual pulse rate in Hz and individual energy level in joules is at least about 1012.

23. The pulsed lamp system of claim 21, wherein the product of the individual pulse rate in Hz and individual energy level in joules is at least about 1152.

24. The pulsed lamp system of claim 21, wherein the product of the individual pulse rate in Hz and individual energy level in joules is at least about 1314.

25. The pulsed lamp system of claim 21, wherein the product of the individual pulse rate in Hz and individual energy level in joules is at least about 1458.

26. The pulsed lamp system of claim 21, wherein the product of the individual pulse rate in Hz and individual energy level in joules is at least about 1727.

27. The pulsed lamp system of claim 21, wherein the product of the individual pulse rate in Hz and individual energy level in joules is at least about 1944.

28. A pulsed lamp system comprising:

a first pulsed gas discharge lamp for connection to a power source;

a second pulsed gas discharge lamp for connection to the power source in parallel to the first pulsed gas discharge lamp;

a control system for alternatingly triggering the first and second gas discharge lamps at an individual pulse rate and an individual energy level that would otherwise cause at least one of the first and second discharge lamps to exhibit unreliable operating behavior if said lamp was operated alone.

29. The pulsed lamp system of claim 28, wherein the unreliable operating behavior is at least one of self-triggering, hold-over, and said lamp operating in a simmering mode.

30. The pulsed lamp system of claim 1, wherein the first pulsed gas discharge lamp and the second pulsed gas discharge lamp are disposed on a first side of a work piece to be illuminated.

31. The pulsed lamp system of claim 1, in combination with a work piece, the work piece having a first side and a second side, the first pulsed gas discharge lamp and the second pulsed gas discharge lamp being disposed to illuminate the first side of the work piece.

32. The pulsed lamp system of claim 9, wherein the first pulsed gas discharge lamp and the second pulsed gas discharge lamp are disposed on a first side of a work piece to be illuminated.

33. The pulsed lamp system of claim 9, in combination with a work piece, the work piece having a first side and a second side, the first pulsed gas discharge lamp and the second pulsed gas discharge lamp being disposed to illuminate the first side of the work piece.

34. The pulsed lamp system of claim 21, wherein the first pulsed gas discharge lamp and the second pulsed gas discharge lamp are disposed on a first side of a work piece to be illuminated.

35. The pulsed lamp system of claim 21, in combination with a work piece, the work piece having a first side and a second side, the first pulsed gas discharge lamp and the second pulsed gas discharge lamp being disposed to illuminate the first side of the work piece.

36. The pulsed lamp system of claim 28, wherein the first pulsed gas discharge lamp and the second pulsed gas discharge lamp are disposed on a first side of a work piece to be illuminated.

37. The pulsed lamp system of claim 28, in combination with a work piece, the work piece having a first side and a second side, the first pulsed gas discharge lamp and the second pulsed gas discharge lamp being disposed to illuminate the first side of the work piece.

* * * * *